US007930794B2

(12) United States Patent
Tsutanaga et al.

(10) Patent No.: US 7,930,794 B2
(45) Date of Patent: Apr. 26, 2011

(54) CLEANING TOOL

(75) Inventors: Hajime Tsutanaga, Fukuoka (JP); Jun Uragami, Fukuoka (JP); Toshihiko Uenishi, Fukuoka (JP); Masaho Hayashi, Tokyo (JP); Yoshinori Tanaka, Kagawa-ken (JP)

(73) Assignee: Uni-Charm Corporation, Ehime (JP)

( * ) Notice: Subject to any disclaimer, the term of this patent is extended or adjusted under 35 U.S.C. 154(b) by 346 days.

(21) Appl. No.: 12/042,416

(22) Filed: Mar. 5, 2008

(65) Prior Publication Data

US 2008/0216269 A1 Sep. 11, 2008

(30) Foreign Application Priority Data

Mar. 5, 2007 (JP) ..... 2007-054928

(51) Int. Cl.
*A47L 13/16* (2006.01)
*A47L 13/46* (2006.01)

(52) U.S. Cl. ..... 15/229.3; 15/209.1

(58) Field of Classification Search ..... 15/229.1, 15/229.3, 231
See application file for complete search history.

(56) References Cited

U.S. PATENT DOCUMENTS 1,437,145 A * 11/1922 Johnson ..... 15/210.1
2006/0101602 A1* 5/2006 Lin et al. ..... 15/229.3
2008/0040879 A1* 2/2008 Yang ..... 15/231

FOREIGN PATENT DOCUMENTS

JP 09-154791 A 6/1997

* cited by examiner

*Primary Examiner* — Monica S Carter
*Assistant Examiner* — Stephanie Newton
(74) *Attorney, Agent, or Firm* — Brinks Hofer Gilson & Lione

(57) ABSTRACT

A cleaning tool and an effective technique for realizing a higher cleaning effect in a cleaning tool having a cleaning element for wiping a region to be cleaned is disclosed. The cleaning tool includes an elongate cleaning element holder and a cleaning element to be attached to the cleaning element holder. The cleaning element holder has a holding part extending elongate while having components extending in a direction crossing the extending direction of the cleaning element holder. The cleaning element has an insert region into which the holding part is inserted. The cleaning element is attached to the cleaning element holder while being twisted along an extending portion of the holding part through insertion of the holding part into the insert region.

13 Claims, 4 Drawing Sheets

CLEANING TOOL

CROSS-REFERENCE TO RELATED APPLICATION

The present application claims priority under 35 U.S.C. §119 to Japanese Patent Application No. 2007-054928 filed on Mar. 5, 2007. The content of the application is incorporated herein by reference in its entirety.

BACKGROUND OF THE INVENTION

1. Field of the Invention

The present invention relates to a cleaning tool, and more particularly to a cleaning tool having a cleaning element for wiping a region to be cleaned inside a room or a vehicle.

2. Description of the Related Art

Various types of cleaning tools with a sheet-type cleaning element for wiping a cleaning region are known. For example, Japanese non-examined laid-open Patent Publication No. 9-154791 discloses a cleaning tool having cleaning fabric and a holder that detachably holds the cleaning fabric inserted into a holding region of the cleaning fabric. This cleaning tool is capable of wiping a region to be cleaned by using the cleaning fabric held via the holder. However, in designing a cleaning tool of this type having a cleaning element, it is required to provide an effective technique for enhancing its cleaning effect.

SUMMARY OF THE INVENTION

Accordingly, it is an object of the invention to provide an effective technique for realizing a higher cleaning effect in a cleaning tool having a cleaning element for wiping a region to be cleaned.

The above-described object can be achieved by the features of the claimed invention. This invention can be applied to the construction of cleaning tools for cleaning regions to be cleaned (floors, walls, ceilings, external walls, furniture, clothes, curtains, bedding, home electric appliances, etc.) inside and outside of houses, apartments, buildings, factories, vehicles, etc. or regions of human body parts to be cleaned. These regions to be cleaned may be either flat or curved, uneven or stepped.

A cleaning tool according to an embodiment of this invention is used for wiping a region to be cleaned and includes at least a cleaning element holder and a cleaning element. The cleaning element holder is an elongate member. The cleaning element holder has a holding part extending elongate while having components extending in a direction crossing the extending direction of the cleaning element holder. The cleaning element is designed to be attached to the elongate cleaning element holder. The cleaning element has an insert region into which the holding part is inserted. The cleaning element is attached to the cleaning element holder while being twisted along an extending portion of the holding part through insertion of the holding part into the insert region. In other words, a converting mechanism that converts the inserting motion of inserting the holding part into the insert region to the twisting motion of the cleaning element is realized by cooperation between the holding part of the cleaning element holder and the insert region of the cleaning element. The insert region may be formed by a single insert portion extending elongate or by a plurality of insert portions extending discontinuously.

With such a construction of the cleaning tool, by inserting the holding portion of the cleaning element holder into the insert region of the cleaning element, the cleaning element can be twisted in a predetermined manner and held in this state by the cleaning element holder. In this case, by twisting the cleaning element, a cleaning face is created over the entire face of the cleaning element around the cleaning element holder, and the volume of the cleaning element is increased. Therefore, dust can be trapped on the entire face of the cleaning element, so that the cleaning effect can be enhanced. Further, as the cleaning face is created over the entire face of the cleaning element, the user can use the cleaning tool without being concerned about the position of the cleaning face of the cleaning element during cleaning operation, so that the operability is improved. Particularly, the cleaning element is efficiently twisted through insertion of the holding portion of the cleaning element holder into the insert region of the cleaning element.

Further, in the cleaning element, the holding part extending elongate while having components extending in a direction crossing the extending direction of the cleaning element holder may be formed by a single elongate portion or by a combination of a plurality of elongate portions extending parallel to each other.

Further, the cleaning element may be of disposable type designed for single use, disposable type designed for multiple use which can be used several times, while holding dust which has been removed from the region to be cleaned, on a brush portion, or reusable type which can be reused by washing.

A cleaning tool of another embodiment according to this invention is used for wiping a region to be cleaned and includes at least an elongate cleaning element holder and a cleaning element to be attached to the cleaning element holder. The cleaning element holder has a holding part extending elongate while having components extending in a direction crossing the extending direction of the cleaning element holder. The cleaning element has an insert region into which the holding part is inserted. The length of the holding part in the extending direction of the cleaning element holder and the length of the components of the holding part which extend in the direction crossing the extending direction of the cleaning element holder define the length and the width of an effective cleaning region of the cleaning element, respectively. The effective cleaning region herein refers to a region of the cleaning element which has a substantial cleaning function and generally coincides with a region to which load is applied from the holding part during cleaning operation. In this case, the effective cleaning region of the cleaning element may be defined by the length or the width obtained by adding a specified length or width to the length or width of the region demarcated by the holding part, or by the length or width itself of the region demarcated by the holding part.

With such a construction, when the cleaning element is attached to the cleaning element holder, the volume of the cleaning element can be increased in the direction crossing the extending direction of the cleaning element holder by the components of the holding part of the cleaning element holder which extend in the direction crossing the extending direction of the cleaning element holder. Therefore, the cleaning effect can be enhanced. Further, the length and the width of the effective cleaning region of the cleaning element can be defined by the size of the holding part of the cleaning element holder.

A cleaning tool of another embodiment according to this invention is used for wiping a region to be cleaned and includes at least an elongate cleaning element holder and a cleaning element to be attached to the cleaning element holder. The cleaning element holder has a holding part extending elongate while having components extending in a direction crossing the extending direction of the cleaning element holder. The cleaning element has an insert region into which the holding part is inserted. The sectional area or the projected area of the holding parts in the direction crossing the extending direction of the cleaning element holder defines the sectional area of the effective cleaning region of the cleaning element. In this case, the effective cleaning region of the cleaning element may be defined by the sectional area obtained by adding a specified area to the sectional area of the region demarcated by the holding part, or by the sectional area itself of the region demarcated by the holding part.

With such a construction, when the cleaning element is attached to the cleaning element holder, the volume of the cleaning element can be increased in the direction crossing the extending direction of the cleaning element holder by the components of the holding part of the cleaning element holder which extend in the direction crossing the extending direction of the cleaning element holder. Therefore, the cleaning effect can be enhanced. Further, the sectional area of the effective cleaning region of the cleaning element can be defined by the size of the holding part of the cleaning element holder.

In a further embodiment of the cleaning element according to this invention, preferably, the holding part has an extending portion having a predetermined twisted form, and the cleaning element is attached to the cleaning element holder while being twisted along the extending portion of the holding part through insertion of the holding part into the insert region. With such a construction, the cleaning element is twisted along the twisted form of the holding part when the cleaning element is attached to the cleaning element holder. Thus, the cleaning face is created over the entire face of the cleaning element around the cleaning element holder, and the volume of the cleaning element is increased. Therefore, dust can be trapped on the entire face of the cleaning element, so that the cleaning effect can be further enhanced. Further, as the cleaning face is created over the entire face of the cleaning element, the user can use the cleaning tool without being concerned about the position of the cleaning face of the cleaning element during cleaning operation, so that the operability is improved.

In a further embodiment of the cleaning element according to this invention, preferably, the holding part includes two holding elements extending in a helical form and parallel to each other, and the insert region is demarcated as assigned regions into which the holding elements are inserted. With such a construction, the cleaning element can be held by the cleaning element holder in the helically twisted state by inserting the two holding elements of the cleaning element holder into the assigned insert regions of the cleaning element.

In a further embodiment of the cleaning element according to this invention, preferably, the holding part has a double helical structure formed by the two holding elements. The "double helical structure" herein represents the structure having two helical lines extending in a manner of wrapping around each other and also refers to the regular conformation of duplex DNA. With such a construction, the cleaning element can be held in the regularly twisted state by inserting the two holding elements having the double helical structure into the assigned insert regions of the cleaning element As described above, in a cleaning tool having a cleaning element for wiping a region to be cleaned, particularly by provision of the construction in which a cleaning element holder has a holding part extending elongate while having components extending in a direction crossing the extending direction of the cleaning element holder, the volume of the cleaning element can be increased in the direction crossing the extending direction of the cleaning element holder when the cleaning element is attached to the cleaning element holder. Therefore, the cleaning effect of the cleaning element can be enhanced. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide improved cleaning tools and method for using such cleaning tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A representative embodiment of the present invention is now described with reference to the drawings. First, the structure of a cleaning tool 100 according to this embodiment is explained with reference to FIGS. 1 to 3. Objects to be cleaned with the cleaning tool 100 includes regions to be cleaned (floors, walls, windows, ceilings, external walls, furniture, clothes, curtains, bedding, lighting, home electric appliances, etc.) inside and outside of houses, apartments, buildings, factories, vehicles, etc. and regions of human body parts to be cleaned. These regions to be cleaned may be either flat or curved, uneven or stepped.

Figure 1:
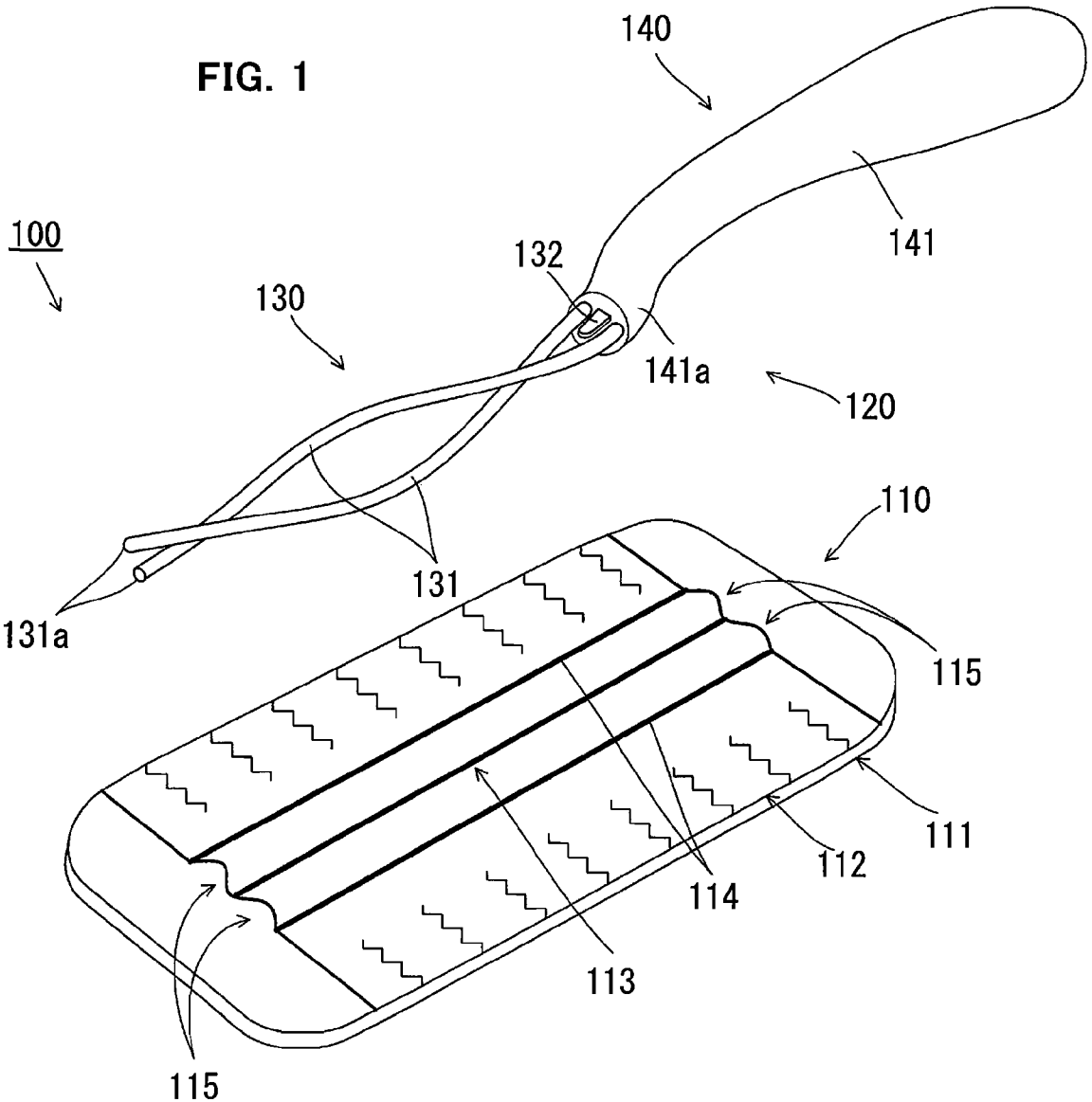
FIG. 1 is a perspective view showing a cleaning tool 100 according to an embodiment of the present invention, in a disassembled state into a cleaning element 110 and a cleaning element holder 120.

FIG. 1 shows the cleaning tool 100 according to this embodiment in perspective view, in a state disassembled into a cleaning element 110 and a cleaning element holder 120. As shown in FIG. 1, the cleaning tool 100 comprises the cleaning element 110 and the cleaning element holder 120.

The cleaning element 110 has a function of removing dirt on the region to be cleaned. The cleaning element 110 is available in a sheet-like form, and in use, it is loosened such that its volume is increased. As shown in FIG. 1, the cleaning element 110 is a sheet element having a rectangular shape in plan view and extending in a predetermined longitudinal direction (the direction of the length), which will be explained in more detail below. The cleaning element 110 includes a cleaning element body 111 and a holding sheet 112 stacked and fusion bonded together at a fusion bonded part 113 and fusion bonded parts 114 which are parallel to each other. A pair of right and left spaces demarcated by the fusion bonded parts 113, 114 form insert regions 115 into which holding portions (holding elements 131 of a holder body 130 which is described below) of the cleaning element holder 120 are inserted. The insert regions 115 are shaped to have adequate size (insertion width and insertion depth) to receive the holding elements 131 of the holder body 130. The cleaning element 110 is a feature that corresponds to the "cleaning element" according to an embodiment of this invention. The cleaning element 110 may also have a square or other shape in plan view as necessary. Further, the insert regions 115 are the features that correspond to the "insert regions" according to an embodiment of this invention. Each of the insert regions 115 may be formed by a single insert portion extending elongate or by a plurality of insert portions extending discontinuously.

The cleaning element holder 120 is removably attached to the cleaning element 110. The cleaning element holder 120 is an elongate member including the holder body 130 and the handle 140 connected to each other. The cleaning element holder 120 is a feature that corresponds to the "cleaning element holder" according to an embodiment this invention. The handle 140 includes a handle body 141 extending in an elongate form and a connection 141*a* disposed between the handle body 141 and the holder body 130. The handle body 141 is a portion to be held by a user. The handle body 141 and the holder body 130 are fixedly connected at the connection 141*a*.

The holder body 130 has a function of detachably holding the cleaning element 110. The holder body 130 includes two holding elements 131 extending from the connection 141*a* substantially in the same direction as the handle body 141. The holding elements 131 have a twisted form extending in the extending direction of the holder body 130 while having components extending in a direction crossing the extending direction of the holder body 130. Specifically, the holding elements 131 form a so-called double helical structure extending in a twisted or helical form and parallel to each other with a predetermined spacing. The double helical structure having two helical lines extending in a manner of wrapping around each other also refers to the regular conformation of duplex DNA. Further, each of the holding elements 131 can have a twist angle appropriately selected as necessary, such as 180°, 270° and 360°. The two holding elements 131 herein form the "holding part" and the "two holding elements" according to an embodiment this invention. The holding elements 131 can have an appropriately selected sectional shape such as a circular or polygonal section forming a rod-like shape and a rectangular section forming a plate-like shape. Particularly, the rod-like shape having a circular section can minimize the insertion resistance of the holding elements 131 when the cleaning element is attached to the holder, and thus allows smooth insertion of the holding elements 131.

The length and the width of the effective cleaning region of the cleaning element 110 can be defined by the length of the holding elements 131 in the extending direction of the holder body 130 and by the length of components of the holding elements 131 which extend in a direction crossing the extending direction of the holder body 130, respectively. The effective cleaning region herein refers to a region of the cleaning element 110 which has a substantial cleaning function and generally coincides with a region to which load is applied from the holding elements 131 during cleaning operation. In this case, the effective cleaning region of the cleaning element 110 may be defined by the length or the width obtained by adding a specified length or width to the length or width of the region demarcated by the holding elements 131, or by the length or width itself of the region demarcated by the holding elements 131.

Alternatively or additionally, the sectional area of the effective cleaning region of the cleaning element 110 can be defined by the sectional area or the projected area of the holding elements 131 in the direction crossing the extending direction of the holder body 130. In this case, the effective cleaning region of the cleaning element 110 may be defined by the sectional area obtained by adding a specified area to the sectional area of the region demarcated by the holding elements 131, or by the sectional area itself of the region demarcated by the holding elements 131. The holding elements 131 can have at least either this construction in which the sectional area of the effective cleaning region of the cleaning element 110 is defined, or the above-described construction in which the length and the width of the effective cleaning region of the cleaning element 110 is defined.

A retaining plate 132 is provided on the end of the connection 141*a* of the handle 140. The retaining plate 132 extends forward between the two holding elements 131 and is convexly curved downward. The retaining plate 132 further has an engagement lug (not shown) on the underside.

Figure 2:
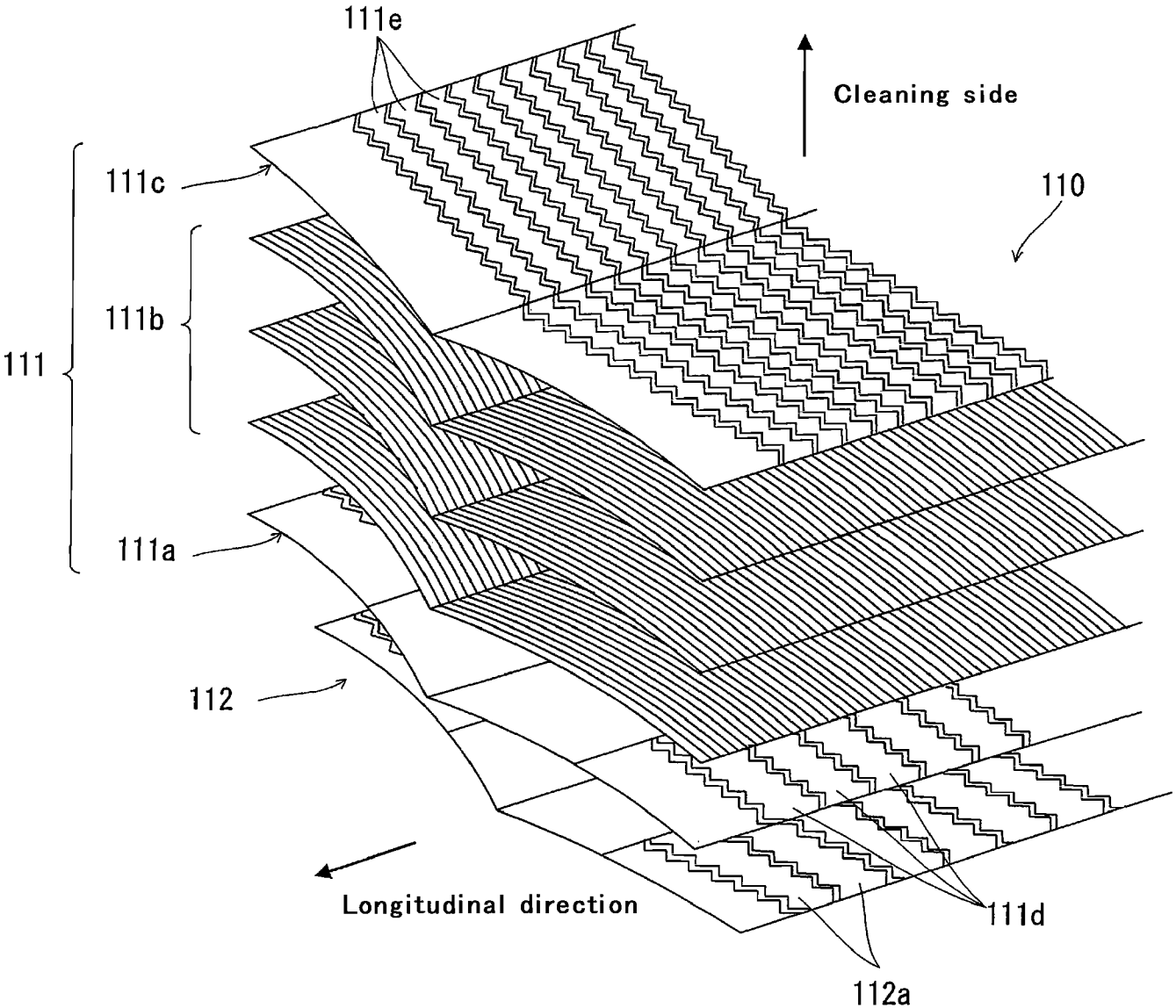
FIG. 2 is a perspective view of the cleaning element 110 of FIG. 1 which is shown separated into component elements.

Referring to FIG. 2, the structure of the cleaning element 110 is specifically described. FIG. 2 is a perspective view of the cleaning element 110 of FIG. 1 which is shown separated into component elements.

As shown in FIG. 2, in the cleaning element 110 of this embodiment, the holding sheet 112 is overlaid on the cleaning element body 111 on the cleaning side (which is also referred to as the "lower region side" or the "back"). Further, the cleaning element body 111 has a cleaning side sheet 111*c*, a fiber assembly 111*b* and a base sheet 111*a* placed one on the other in this order from the cleaning side (lower region side). In this case, the holding sheet 112 and the base sheet 111*a* are overlaid on the side of the fiber assembly 111*b* opposite the cleaning side sheet 111*c* (lower region side sheet) and form an upper region side sheet.

The base sheet 111*a*, the fiber assembly 111*b* and the cleaning side sheet 111*c* which form the cleaning element body 111 have the same rectangular sheet-like form in plan view and extend in a longitudinal direction of the cleaning element 110. The fiber assembly 111*b* and the cleaning side sheet 111*c* form a brush-like part having a dirt removing function, which is also referred to as the "brush portion". The cleaning element 110 may be of disposable type designed for single use, disposable type designed for multiple use which can be used several times, while holding dust which has been removed from the region to be cleaned, on the brush portion, or reusable type which can be reused by washing. Further, in this embodiment, the cleaning element body 111 of the cleaning element 110 is described as a structure having the base sheet 111*a*, the fiber assembly 111*b* and the cleaning side sheet 111*c* stacked in layer, but may be constructed as a structure having an additional fiber layer and/or sheet.

The holding sheet 112, the base sheet 111*a* and the cleaning side sheet 111*c* have a plurality of zigzag strips (strip portions) extending in a direction crossing the longitudinal direction of the cleaning element 110. Specifically, the holding sheet 112 comprises a plurality of strips 112*a* arranged in parallel and extending in a direction crossing the longitudinal direction of the cleaning element 110. The base sheet 111*a* comprises a plurality of strips 111*d* arranged in parallel and extending in a direction crossing the longitudinal direction of the cleaning element 110. The cleaning side sheet 111*c* comprises a plurality of strips 111*e* arranged in parallel and extending in a direction crossing the longitudinal direction of the cleaning element 110. An improved structure which can easily trap dust and thus has a higher cleaning function can be realized by the zigzag strips of the sheets. The strips may have the same kind or different kinds of shape appropriately selected from various shapes, such as zigzag, linear and curved shapes.

The construction of the nonwoven fabric forming the above-described base sheet 111*a*, cleaning side sheet 111*c* and holding sheet 112 and the construction of the fiber assembly 111*b* are now explained in detail.

The base sheet 111*a*, the cleaning side sheet 111*c* and the holding sheet 112 can typically be formed of sheet-type nonwoven fabric comprising thermal melting fibers (thermoplastic fibers) and thus referred to as nonwoven fabric sheet. The nonwoven fabric has a sheet-like configuration formed by fixing or entangling fibers by mechanical, chemical or heat treatment. The nonwoven fabric partly includes thermoplastic fibers and thus can be fusion bonded. Further, the nonwoven fabric has a plurality of strips. Examples of the thermal melting fibers (thermoplastic fibers) include polyethylene, polypropylene and polyethylene terephthalate. The nonwoven fabric may be manufactured by through-air bonding, spun bonding, thermal bonding, spun lacing, point bonding, melt blowing, stitch bonding, chemical bonding, needle punching or other similar processes. In order to enhance the dust wiping function, it is preferred to use a nonwoven fabric having higher rigidity. Further, as an alternative to or in addition to the nonwoven fabric, a material to be worked into strips, such as urethane, sponge, woven fabric, net and split cloth, may be used.

The fiber assembly 111*b* is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber assembly 111*b* partially includes thermoplastic fibers and can be fusion bonded. The fibers forming the fiber assembly 111*b* are elements of yarn, textile or the like and defined as being thin and flexible fibers having a substantially longer length compared with the thickness. Typically, a long continuous fiber is defined as a filament and a short fiber as a staple. The proximal ends of the fibers of the fiber assembly 111*b* are bonded at the fusion bonded parts 113 and 114. The fibers of the fiber assembly 111*b* each have one end fixed at the fusion bonded parts and the other free end (distal end) on the opposite side. The fibers of the fiber assembly 111*b* extend in a direction crossing the longitudinal direction of the cleaning element 110 (or the fiber assembly 111*b*). The fiber assembly 111*b* extending in a direction crossing the longitudinal direction of the cleaning element 110 is a feature that corresponds to the "fiber assembly comprising a plurality of fibers extending in the predetermined direction" according to this embodiment. The fiber assembly 111*b* is also referred to as the "fiber bundle" having a plurality of fibers in a bundle.

In the representative example shown in FIG. 2, the fiber assembly 111*b* comprises three fiber layers, but it may comprise one or more fiber layers as necessary. Preferably, the fiber assembly 111*b* has a planar structure having a predetermined flat or curved region and has a three-dimensional form having a certain thickness or has a thin sheet-like form. The "fiber assembly" is typically formed of polyethylene (PE), polypropylene (PP), polyethylene terephthalate (PET), nylon, rayon or the like. In practical use, an assembly of filaments formed by opening a tow is frequently used as the fiber assembly. It is particularly preferable that the fiber assembly comprises conjugated fibers having a core of polypropylene (PP) or polyethylene (PE) and a core covering sheath of polyethylene (PE). Further, the filaments of the fiber assembly are preferred to have a fineness of 1 to 50 dtex, more preferably 2 to 10 dtex. The individual fiber assembly may contain fibers of substantially the same fineness or of different finenesses.

Further, in order to enhance the dust wiping function, it is preferred to use a fiber assembly including fibers having higher rigidity or fibers having higher fineness. It is further preferred that the fiber assembly has crimped fibers. Here, the crimped fibers are fibers subjected to a predetermined crimping process and easily entangled with each other. With the fibers being crimped, the fiber assembly becomes bulkier than before the holder is attached thereto, and dust can be easily captured by the crimped portions. This structure can be realized especially by using crimped fibers opened from a tow.

For the fiber assembly, flat yarns or split yarns may also be employed. The flat yarns are prepared by slitting a film into tapes and by stretching the tapes in the longitudinal direction. The split yarns are prepared by splitting a thermoplastic film resin in the direction perpendicular to the orientation direction of the resin so that the film is fibrillated and interconnected into a net shape. Alternatively, a nonwoven fabric which is bulky and has low fiber density, such as a through-air bonded nonwoven fabric, may be employed to form the fiber assembly.

The kinds and numbers of the component parts of the cleaning element 110 are not limited to those described in the above-described example, and can be selected as necessary.

Figure 3:
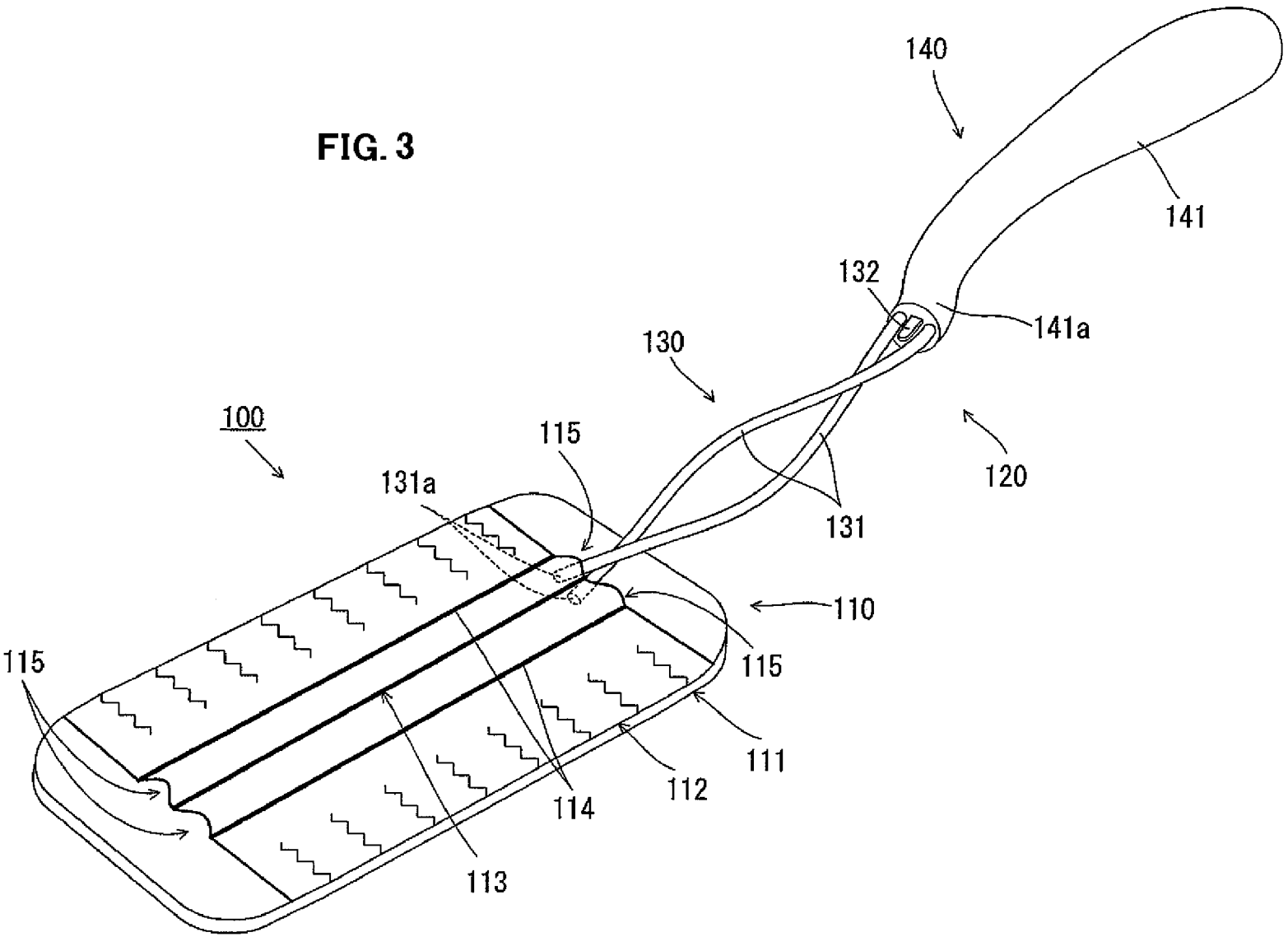
FIG. 3 is a perspective view showing the process of attaching the cleaning element 110 to the cleaning element holder 120 in this embodiment.
Figure 4:
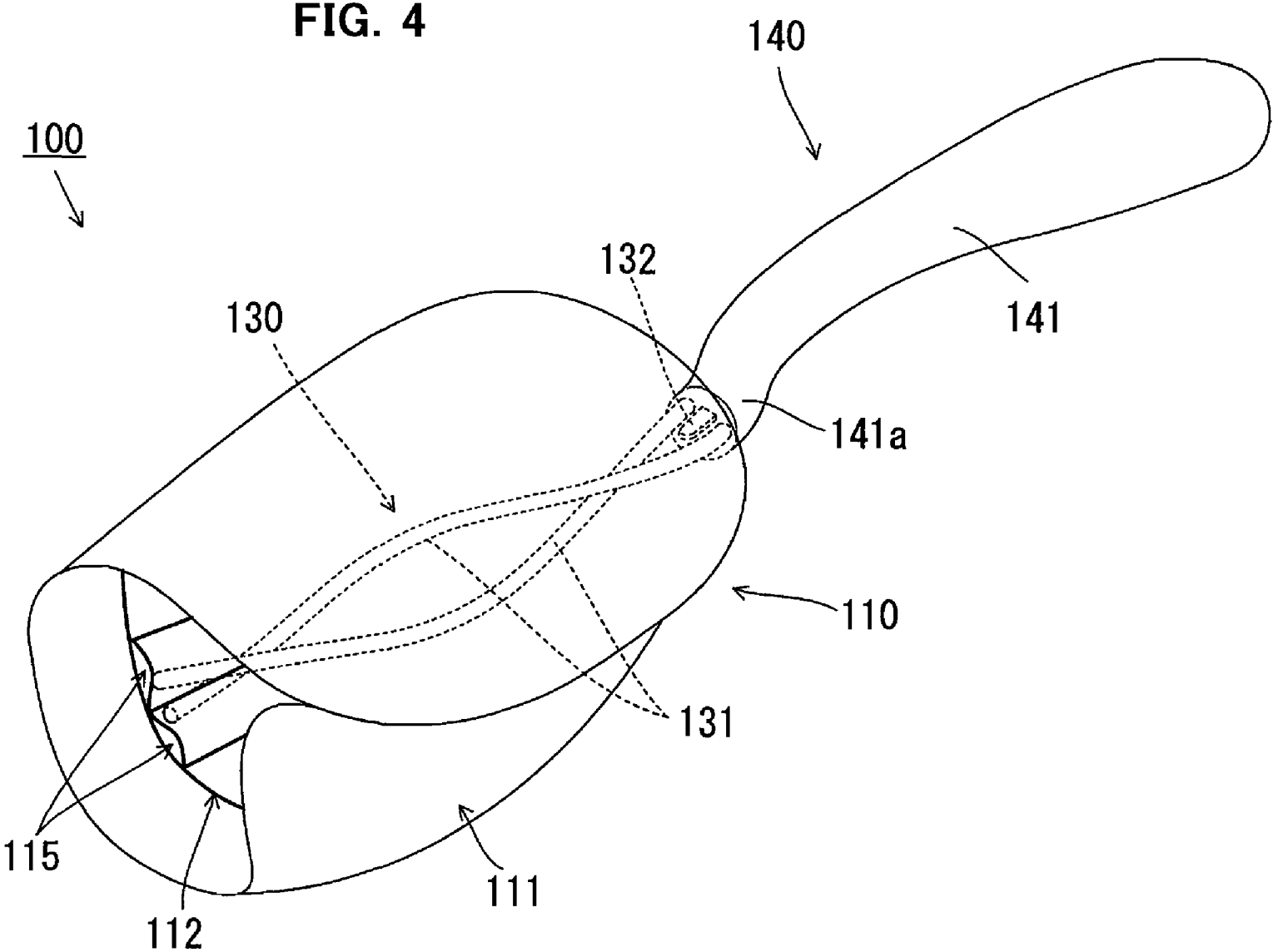
FIG. 4 is a perspective view showing the process of attaching the cleaning element 110 to the cleaning element holder 120 in this embodiment.

Now, the manner of attaching the cleaning element 110 and the cleaning element holder 120 which have the above-described construction to each other is explained with reference to FIGS. 3 and 4. FIGS. 3 and 4 are perspective views showing the process of attaching the cleaning element 110 to the cleaning element holder 120 in this embodiment.

First, as shown in FIG. 3, tips 131*a* of the holding elements 131 of the holder body 130 are inserted into the assigned insert regions 115 of the cleaning element 110. Then, the holder body 130 is further pushed in along the extending direction of the insert regions 115. Thus, the cleaning element 110 is attached to the holder body 130 while being twisted along the extending portions of the holding elements 131 through insertion of the holding elements 131 into the insert regions 115. In other words, a converting mechanism that converts the inserting motion of inserting the holding elements 131 into the insert regions 115 to the twisting motion of the cleaning element 110 is realized by cooperation between the holding elements 131 of the holder body 130 and the insert regions 115 of the cleaning element 110.

In the state of completion of insertion of the holding elements 131 into the insert regions 115, the holding elements 131 are fitted in the insert regions 115 of the cleaning element 110 by close sliding contact, so that the cleaning element 110 is securely attached to the holding elements 131. In this case, preferably, the spacing between the holding elements 131 is substantially equal to or slightly shorter than the distance between the fusion bonded parts 114. With such a construction, the effect of secure attachment of the holding elements to the cleaning element 110 can be enhanced. Further, in this inserted state, the retaining plate 132 presses the cleaning element 110 from above, and the engagement lug (not shown) formed on the underside of the retaining plate 132 serves as a stopper for preventing the cleaning element 110 from coming off. Thus, in the inserted state in which the holding elements 131 are inserted into the insert regions 115 of the cleaning element 110, the cleaning element 110 is reliably retained by the holder body 130.

In this manner, the cleaning element 110 is wrapped around the holding element 131 while being subjected to predetermined torsion or twist. As a result, the volume of the sheet-type cleaning element 110 can be increased. Further, preferably, before or after such wrapping of the cleaning element 110, the cleaning element 110 is loosened by hand such that its volume is increased. Further, a cleaning face is created over the entire face of the cleaning element 110. Therefore, dust can be trapped on the entire face of the cleaning element 110, and the user can use the cleaning tool without being concerned about the position of the cleaning face of the cleaning element 110 during cleaning operation.

The present invention is not limited to the embodiment as described above, but rather, may be added to, changed, replaced with alternatives or otherwise modified. For example, the following provisions can be made in application of this embodiment.

In this invention, it is essential that predetermined torsion or twist can be applied to the cleaning element 110. Therefore, cleaning element holders having a construction which is different from that of the cleaning element holder 120 in the above embodiment can be appropriately used. For example, the holding part to be inserted into the insert region of the cleaning element may be formed by a combination of a plurality of elongate portions extending parallel to each other, like the two holding elements 131 having the above-described construction, or by a single elongate portion. In this case, preferably, the single elongate portion has a helical form like the holding elements 131.

Further, in the above embodiment, the cleaning element 110 is described as being formed by the sheet-type nonwoven fabric and the fiber assembly. In this invention, however, the cleaning element may be formed only by sheet-type nonwoven fabric.

While the invention has been particularly shown and described with reference to preferred embodiments thereof, it will be understood by those skilled in the art that various changes in form and details may be made therein without departing from the spirit and scope of the invention.

What we claim is:

1. A cleaning tool for wiping a region to be cleaned comprising:

an elongate cleaning element holder, and a cleaning element to be attached to the cleaning element holder, the cleaning element holder having a holding part extending elongate while having a plurality of spaced apart components extending in a direction crossing an extending direction of the cleaning element holder, the cleaning element having a plurality of non-coextensive insert regions into which the plurality of spaced apart components of the holding part are inserted so that individual ones of the plurality of spaced apart components of the holding part are received in separate ones of the plurality of non-coextensive insert regions, said plurality of non-coextensive insert regions have lengths and are non-coextensive along their entire lengths, wherein the cleaning element is attached to the cleaning element holder while being twisted along an extending portion of the holding part through insertion of the plurality of spaced apart components of the holding part into the non-coextensive insert regions.

2. The cleaning tool according to claim 1, wherein plurality of spaced apart components of the holding part comprise two holding elements extending in a helical form and parallel to each other, and the plurality of non-coextensive insert regions are demarcated as assigned regions into which the two holding elements are inserted.

3. The cleaning tool as defined in claim 2, wherein the holding part has a double helical structure formed by the two holding elements.

4. A cleaning tool for wiping a region to be cleaned comprising:

an elongate cleaning element holder, and a cleaning element to be attached to the cleaning element holder, the cleaning element holder having a holding part extending elongate while having a plurality of spaced apart components extending in a direction crossing an extending direction of the cleaning element holder, the cleaning element having a plurality of non-coextensive insert regions into which plurality of spaced apart components of the holding part is inserted so that individual one of the plurality of spaced apart components of the holding part are received in separate ones of the plurality of non-coextensive insert regions, said plurality of non-coextensive insert regions have lengths and are non-coextensive along their entire lengths, wherein a length of the holding part in the extending direction of the cleaning element holder and a length of the plurality of spaced apart components of the holding part which extend in the direction crossing the extending direction of the cleaning element holder define a length and width of an effective cleaning region of the cleaning element, respectively.

5. The cleaning tool according to claim 4, wherein the plurality of spaced apart components of the holding part have a predetermined twisted form, and the cleaning element is attached to the cleaning element holder while being twisted along the plurality of spaced apart components of the holding part through insertion of the plurality of spaced apart components of the holding part into the insert region.

6. A cleaning tool for wiping a region to be cleaned comprising:

an elongate cleaning element holder, and a cleaning element to be attached to the cleaning element holder, the cleaning element holder having a holding part extending elongate while having a plurality of spaced apart components extending in a direction crossing an extending direction of the cleaning element holder, the cleaning element having a plurality of non-coextensive insert into which the plurality of spaced apart components of the holding part are inserted so that individual ones of the plurality of spaced apart components of the holding part are received in separate ones of the plurality of non-coextensive insert regions, said plurality of non-coextensive insert regions have lengths and are non-coextensive along their entire lengths, wherein a sectional area of the holding part in the direction crossing the extending direction of the cleaning element holder defines a sectional area of an effective cleaning region of the cleaning element.

7. The cleaning tool according to claim 6, wherein the plurality of spaced apart components of the holding part have a predetermined twisted form, and the cleaning element is attached to the cleaning element holder while being twisted along the plurality of spaced apart components of the holding part through insertion of the plurality of spaced apart components of the holding part into the insert region.

8. The cleaning tool as defined in claim 1, wherein the plurality of spaced apart components of the holding part are coupled to a handle body and have lengths that extend from the handle body to free ends of the plurality of spaced apart components.

9. The cleaning tool according to claim 4, wherein the plurality of spaced apart components of the holding part are coupled to a handle body and have lengths that extend from the handle body to free ends of the plurality of spaced apart components.

10. The cleaning tool according to claim 6, wherein the plurality of spaced apart components of the holding part are coupled to a handle body and have lengths that extend from the handle body to free ends of the plurality of spaced apart components.

11. The cleaning tool as defined in claim 1, wherein the plurality of non-coextensive insert regions are defined by a plurality of equal length bonded parts of the cleaning element.

12. The cleaning tool according to claim 4, wherein the plurality of non-coextensive insert regions are defined by a plurality of equal length bonded parts of the cleaning element.

13. The cleaning tool according to claim 6, wherein the plurality of non-coextensive insert regions are defined by a plurality of equal length bonded parts of the cleaning element.

* * * * *